US011560772B2

(12) United States Patent
Stautzenberger

(10) Patent No.: US 11,560,772 B2
(45) Date of Patent: Jan. 24, 2023

(54) RUNNING TOOL AND METHOD OF CLEANING A DOWNHOLE WELL CASING

(71) Applicant: Halliburton Energy Services, Inc., Houston, TX (US)

(72) Inventor: Arthur Terry Stautzenberger, Georgetown, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 75 days.

(21) Appl. No.: 16/477,495

(22) PCT Filed: Nov. 27, 2018

(86) PCT No.: PCT/US2018/062607
§ 371 (c)(1),
(2) Date: Jul. 11, 2019

(87) PCT Pub. No.: WO2019/104322
PCT Pub. Date: May 31, 2019

(65) Prior Publication Data

US 2020/0115995 A1 Apr. 16, 2020

Related U.S. Application Data

(60) Provisional application No. 62/591,025, filed on Nov. 27, 2017.

(51) Int. Cl.
*E21B 37/00* (2006.01)
*E21B 43/10* (2006.01)
(Continued)

(52) U.S. Cl.
CPC ..... *E21B 37/02* (2013.01); *E21B 17/1078* (2013.01)

(58) Field of Classification Search
CPC ..... E21B 17/1028; E21B 17/1078; E21B 17/1021; E21B 37/02; E21B 37/00; E21B 43/10; E21B 43/105; E21B 43/103
See application file for complete search history.

(56) References Cited

U.S. PATENT DOCUMENTS 2,214,121 A * 9/1940 Costello ..... E21B 37/08 166/147
2,362,198 A * 11/1944 Gibson ..... E21B 37/02 166/173

(Continued)

OTHER PUBLICATIONS

International Search Report and Written Opinion dated Mar. 8, 2019; International PCT Application No. PCT/US2018/062607.

*Primary Examiner* — Kipp C Wallace
(74) *Attorney, Agent, or Firm* — McGuireWoods LLP

(57) ABSTRACT

A running tool coupled to a running string and for operational use in a well casing. The running tool having a collapsed and expanded state, a tubular positioned around the centralizer to hold the centralizer in the collapsed state, a release assembly maneuverable to release the tubular causing the centralizer to enter into an expanded state, and a cleaning device for cleaning walls of the well casing. The cleaning device includes at least one of a scraper, magnet, brush, and a high flow rate circulation valve for channeling fluid from the running string into the well casing. The centralizer functions as a stabilizer in the expanded state protecting the running tool during operation.

20 Claims, 3 Drawing Sheets

(51) Int. Cl.
*E21B 37/02* (2006.01)
*E21B 17/10* (2006.01)

(56) References Cited

U.S. PATENT DOCUMENTS 3,552,486 A * 1/1971 Burns ..... E21B 33/124 166/147
5,785,125 A * 7/1998 Royer ..... E21B 17/1021 166/241.1
6,408,945 B1 * 6/2002 Telfer ..... E21B 23/006 166/311
6,896,064 B2 * 5/2005 Howlett ..... E21B 33/128 166/387
9,279,305 B2 * 3/2016 Linklater ..... E21B 47/117
2002/0139537 A1 10/2002 Young et al.
2003/0150611 A1 * 8/2003 Buytaert ..... E21B 17/1028 166/241.6
2004/0007355 A1 * 1/2004 Hern ..... E21B 37/02 166/173
2004/0112592 A1 * 6/2004 Gremillion ..... E21B 17/1028 166/241.6
2004/0177959 A1 9/2004 Schetky et al.
2004/0261998 A1 * 12/2004 Lavaure ..... E21B 33/138 166/285
2005/0126775 A1 * 6/2005 Van Nguy ..... E21B 17/06 166/125
2009/0025929 A1 1/2009 Buytaert et al.
2010/0236781 A1 9/2010 Mytopher et al.
2010/0243277 A1 * 9/2010 Ring ..... E21B 33/126 166/387
2012/0273237 A1 * 11/2012 Giroux ..... E21B 43/105 166/382
2013/0068481 A1 3/2013 Zhou
2013/0168087 A1 * 7/2013 Linklater ..... E21B 33/12 166/250.17
2015/0275605 A1 * 10/2015 Bennett ..... E21B 33/134 166/298
2016/0305219 A1 * 10/2016 Holloway ..... E21B 23/06
2016/0362959 A1 * 12/2016 Zhou ..... E21B 33/1285

* cited by examiner

RUNNING TOOL AND METHOD OF CLEANING A DOWNHOLE WELL CASING

CROSS REFERENCE TO RELATED APPLICATION

This application claims priority to U.S. Provisional Patent Application No. 62/591,025, filed Nov. 27, 2017, entitled "A Method and Apparatus for Washing an Upper Completion," the entire contents of which are hereby fully incorporated by reference for all purposes.

BACKGROUND

The present disclosure relates, in general, to running tools used on running strings for operational use in downhole well casings and, in particular, to a running tool having a centralizer for stabilizing a running tool and/or running string during well cleaning operations.

When a hydrocarbon well, or water injector well is drilled, casing is installed in the upper region of the well and then, normally, a reservoir liner equipped with a reservoir liner hanger is attached to drill pipe (running string) and ran into the well. Once the reservoir liner is set in place, cement is displaced into the reservoir liner and back up the annulus outside the reservoir liner, cementing it in position; after which, the reservoir liner is left filled with drilling mud. At this stage, mud is circulated through the casing to remove residual cement, metal swarf, etc. The drill pipe is then removed from the well and fitted with a running tool used for cleaning the well casing that can provide high flow rates and high speed rotation of the running string. This operation can be time consuming. During the actual cleaning operation, the running tool can rotate at a high rate of velocity and potentially cause damage. All of this results in additional time and expense for a well site operator.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

While the making and using of various embodiments of the present disclosure are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure. In the interest of clarity, not all features of an actual implementation may be described in the present disclosure. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would be a routine undertaking for those of ordinary skill in the art having the benefit of this disclosure.

The devices and methods discussed herein disclose a running tool for use in a well, i.e. wellbore, that can be used to set tubular casing during a first operation and protect tubular casings from damage during a cleaning operation without the need to change the configuration of the running tool between operations.

Figure 1:
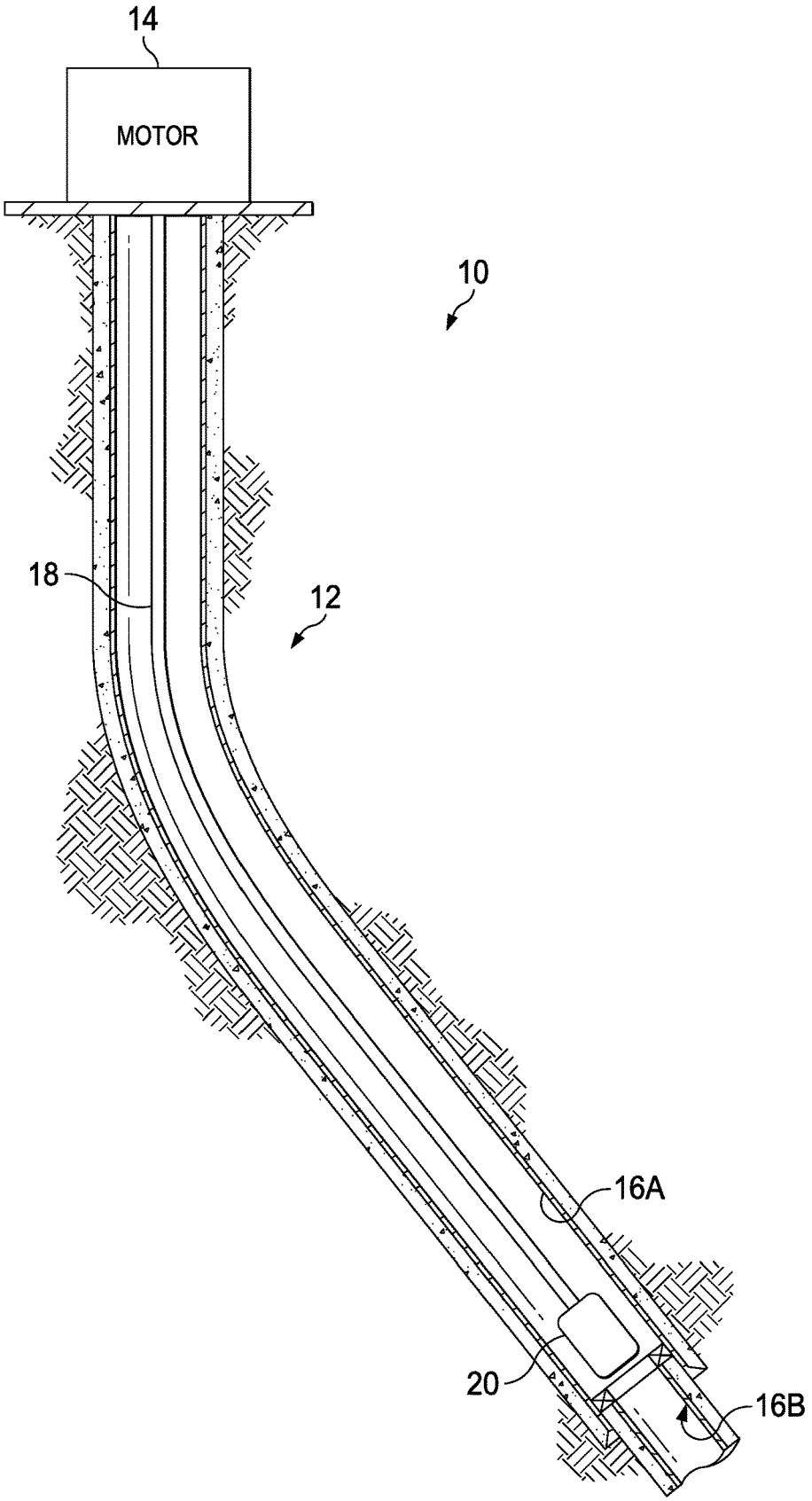
FIG. 1 is an illustration of a well operations site, in accordance with certain example embodiments.

Referring to FIG. 1, illustrated is a well operations site, in accordance with certain example embodiments, denoted generally as 10. The well operations site 10 comprises a well 12 and pumping/drive station 14. The well 12 includes a set of tubular casings 16A and 16B, with a downstream casing being a parent casing to an upstream casing, i.e. casing 16A can be a parent casing to 16B and the inner tubular casings can be referenced to as casing liners. Casing 16B can include a liner hanger assembly, packer, or other liner deployment device and a reservoir liner. It should be understood that the tubular casings can be distinct sections and they also can be a single entity with different sections of the single entity having different diameters. The pump/drive station includes attached thereto a running string 18 and a running tool 20. The running tool 20 can be used to deliver a section of tubular casing in the wellbore and used to clean the casing walls. An advantage of the running tool 20 is that it can be used to deliver the section of tubular and clean the casing walls without removing the running string from the well and changing the running tool.

Figure 2A:
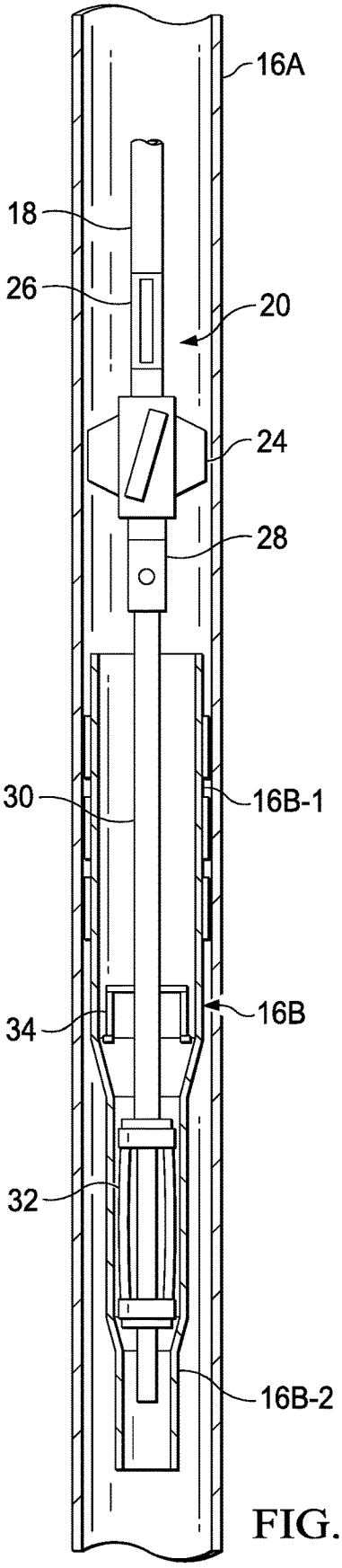
FIG. 2A is an illustration of a running tool for cleaning a well casing of a well, according to certain example embodiments.
Figure 2B:
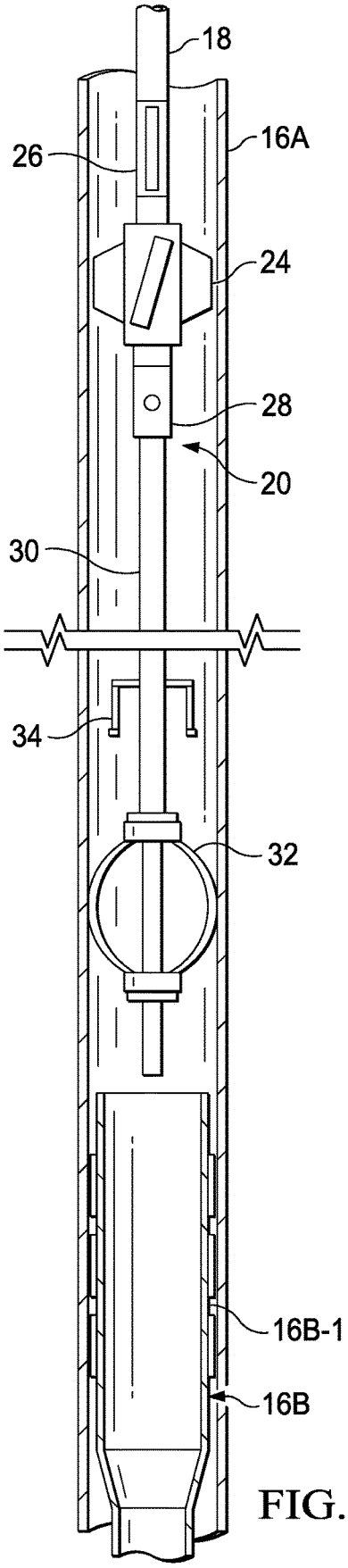
FIG. 2B is another illustration of the running tool for cleaning the well casing, according to certain example embodiments.

Referring now to FIGS. 2A and 2B, illustrated is a running tool 20 for installing a liner hanger, packer, or other liner deployment device 16B-1 into well 12 and then cleaning well 12, in accordance with certain example embodiments. The running tool 20 is coupled to the running sting 18, e.g. drill pipe. The running tool 20 includes at least one cleaning device. The cleaning device can be a scrapper 24, a brush or magnet 26, a high flow rate circulation valve 28, or other similar cleaning devices. Each can be used to clean left over artifacts, such as cement, mud, or debris, from the well casing 16A. The running tool can further include a shaft section 30 coupled to a centralizer 32. The centralizer 32 can be a bow string type centralizer or any other type of retractable centralization device. The centralizer 32 can be fixed or can rotate about the axis of the shaft section 30 as the running tool 20 is used during a cleaning operation.

Tubular casing 16B includes a liner hanger assembly 16B-1 and reservoir liner 16B-2. The liner hanger assembly 16B-1 can be coupled to the running tool 20 and released from the running tool using a mechanical latching device; e.g. collet 34. The liner hanger assembly 16B-1 is installed onto the running tool 20 prior to placement in the well. The centralizer 32 can be mounted onto the shaft section 22 and installed inside the liner hanger assembly 16B-1 or reservoir liner 16B-2 by using a device to force the centralizer 32 into the collapsed state, e.g. a hydraulic cylinder. While the liner hanger 16B-1 is securely coupled to the running tool 20 the liner hanger assembly 16B-1 or reservoir liner 16B-2 remains fitted around centralizer 32 and functions to keep centralizer 32 in a collapsed state, see FIG. 2A. The liner hanger assembly 16B-1 can be positioned within the parent casing 16A and installed by activating a liner hanger setting mechanism which will anchor the liner hanger assembly 16B-1 into the parent casing 16B. As a result the reservoir liner 16B-1 will be suspended in the well and attached to the parent casing 16B through the liner hanger assembly 16B-1. After the liner hanger assembly 16B-1 and reservoir liner 16B-2 have been suspended in the well, the running tool 20 is released from the liner hanger assembly 16B-1. The running string 18 is then pulled from surface which will retrieve the running tool 20 from the liner hanger assembly 16B-1. The centralizer 32, which is suspended from the running tool 20 is also retrieved from the liner hanger assembly 16B-1 or reservoir liner 16B-2 and pulled above the liner hanger assembly 16B-1. In response, centralizer 32 can enter into an expanded state into the parent casing 16A so that the cleaning tool can be used to clean the parent casing 16A, see FIG. 2B. The centralizer 32 in an expanded state can protect the running tool 20 or component parts thereof from damage during the cleaning operation while rotating or reciprocating the running string 18 at high speeds. The centralizer 32 in the expanded state contacts parent casing 16A and exhibits radial force into the parent casing 16A. The radial force of the centralizer 32 stabilizes the running tool 20 during the cleaning operation and acts as barrier between the running tool 20 and the wall of the parent casing 16A.

Figure 3:
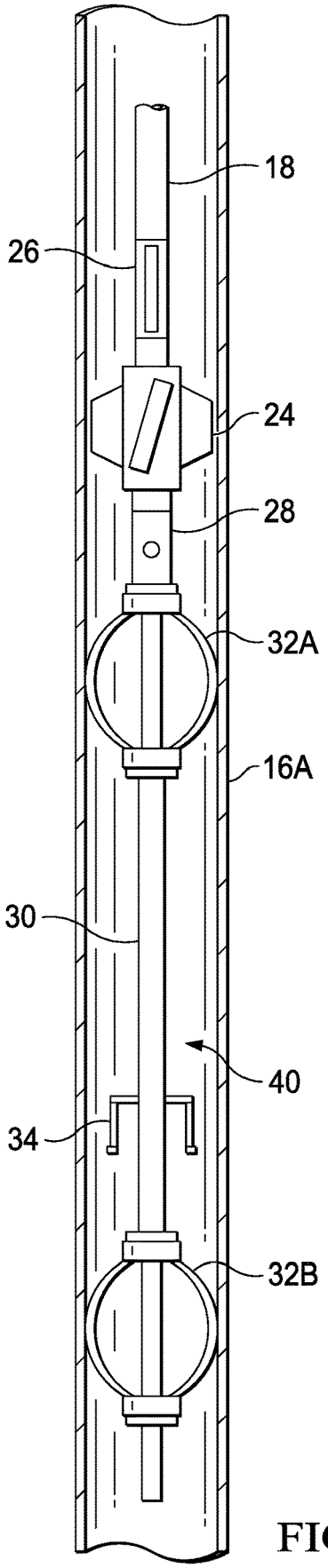
FIG. 3 is an illustration of another running tool for cleaning the well casing, in accordance to certain example embodiments.

Referring to FIG. 3, illustrated is another running tool 40 for cleaning the well casing of the well, in accordance to certain example embodiments. The running tool 40 includes a first centralizer 32A and a second centralizer 32B. The use of two centralizers can help provide additional radial force and stabilization to protect the running tool 40 or component parts therefor during operation. If needed more than two centralizers can be used or the locations of the centralizers can vary. For example, a centralizer can be mounted above or below the cleaning device 26. Centralizer 32A, can be a fixed or bow string type centralizer or any other type of fixed or retractable centralization device.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a running tool coupled to a running string, suspended in a well casing, and rotatable about an axis of the running string, the running tool comprising: a centralizer coupled to the running string, the centralizer having a collapsed and expanded state; a tubular positioned around the centralizer to hold the centralizer in the collapsed state; and a release assembly maneuverable to release the tubular causing the centralizer to enter into an expanded state;

Clause 2, the running tool of clause 1 further comprising a cleaning device for cleaning walls of the well casing;

Clause 3, the running tool of clause 2, wherein the cleaning device comprises at least one of a scraper, magnet, and brush;

Clause 4, the running tool of clause 1, further comprising a high flow rate circulation valve for channeling fluid from the running string into the well casing;

Clause 5, the running tool of clause 1, further comprising a second centralizer coupled to the running string;

Clause 6, the running tool of clause 1, wherein the centralizer functions as a stabilizer in the expanded state protecting the running tool during operation;

Clause 7, the running tool of clause 1 further comprising: a cleaning device for cleaning walls of the well casing; a high flow rate circulation valve for channeling fluid from the running string into the well casing;

Clause 8, the running tool of clause 7, wherein the cleaning device is one of a scraper, magnet, and brush;

Clause 9, the running tool of clause 1, wherein the tubular includes a liner hanger and a first section having a first diameter and at least one other section with each section having a different diameter;

Clause 10, a method of operating a running tool coupled to a running string, suspended in a well casing, and rotatable about an axis of the running string, the method comprising: coupling a centralizer to the running string, the centralizer having a collapsed and expanded state; positioning a tubular around the centralizer to hold the centralizer in the collapsed state; and releasing the tubular causing the centralizer to enter into an expanded state;

Clause 11, the method of clause 10 further comprising cleaning the walls of the well casing using a cleaning device;

Clause 12, the method of clause 11, wherein the cleaning device is at least one of a scraper, magnet, and brush;

Clause 13, the method of clause 10 further comprising channeling fluid from the running sting into the well casing using a circulation valve;

Clause 14, the method of clause 10, wherein the centralizer is rotatable about the axis of the running string;

Clause 15, the method of clause 10, wherein the centralizer functions as a stabilizer in the expanded state protecting the well casing from the running string;

Clause 16, the method of clause 10, wherein the centralizer functions as a stabilizer in the expanded state protecting the well casing during operation of the running tool;

Clause 17, a running tool coupled to a running string, suspended in a well casing, and rotatable about an axis of the running string, the running tool comprising: a running tool protector coupled to the running string, wherein the running tool protector functions as a stabilizer protecting the well casing during operation of the running tool; and comprising a cleaning device for cleaning walls of the well casing;

Clause 18, the running tool of clause 17, wherein the cleaning device comprises at least one of a scraper, magnet, and brush;

Clause 19, the running tool of clause 17 further comprising a high flow rate circulation valve for channeling fluid from the running string into the well casing; and Clause 20, the running tool of clause 17, wherein the running tool protector comprises a set of bowstrings and the running tool protector is rotatable about the axis of the running string.

The foregoing description of embodiments of the disclosure has been presented for purposes of illustration and description. It is not intended to be exhaustive or to limit the disclosure to the precise form disclosed, and modifications and variations are possible in light of the above teachings or may be acquired from practice of the disclosure. The embodiments were chosen and described in order to explain the principals of the disclosure and its practical application to enable one skilled in the art to utilize the disclosure in various embodiments and with various modifications as are suited to the particular use contemplated. Other substitutions, modifications, changes and omissions may be made in the design, operating conditions and arrangement of the embodiments without departing from the scope of the present disclosure. Such modifications and combinations of the illustrative embodiments as well as other embodiments will be apparent to persons skilled in the art upon reference to the description. It is, therefore, intended that the appended claims encompass any such modifications or embodiments.

What is claimed is:

1. A running tool coupled to a running string, suspended in a well casing, and rotatable about an axis of the running string, the running tool comprising:

a centralizer coupled to the running string, the centralizer having a collapsed and expanded state;

a tubular positioned around the centralizer to hold the centralizer in the collapsed state; and a release assembly having a collet initially positioned below a liner hanger portion of the tubular and maneuverable to release the tubular causing the centralizer to automatically enter into an expanded state upon being withdrawn from the tubular, wherein the centralizer is positioned below the collet.

2. The running tool of claim 1 further comprising a cleaning device for cleaning walls of the well casing.

3. The running tool of claim 2, wherein the cleaning device comprises at least one of a scraper, magnet, and brush.

4. The running tool of claim 1 further comprising a high flow rate circulation valve for channeling fluid from the running string into the well casing.

5. The running tool of claim 1, further comprising a second centralizer coupled to the running string.

6. The running tool of claim 1, wherein the centralizer in the expanded state functions to keep the running tool in the center of the well casing and to stabilize the running tool protecting the running tool during operation.

7. The running tool of claim 1 further comprising:

a cleaning device for cleaning walls of the well casing;

a high flow rate circulation valve for channeling fluid from the running string into the well casing.

8. The running tool of claim 7, wherein the cleaning device is one of a scraper, magnet, and brush.

9. The running tool of claim 1, wherein the tubular includes a liner hanger and a first section having a first diameter and at least one other section with each section having a different diameter.

10. A method of operating a running tool coupled to a running string, suspended in a well casing, and rotatable about an axis of the running string, the method comprising:

coupling a centralizer to the running string, the centralizer having a collapsed and expanded state;

positioning a tubular around the centralizer to hold the centralizer in the collapsed state; and releasing the tubular causing the centralizer to automatically enter into an expanded state upon being withdrawn from the tubular, wherein releasing the tubular comprises releasing a collet positioned below a liner hanger assembly that is coupled the running tool, performing a cleaning operation with a cleaning device coupled to the running string.

11. The method of claim 10 wherein performing the cleaning operation further comprises cleaning the walls of the well casing using the cleaning device.

12. The method of claim 11, wherein the cleaning device is at least one of a scraper, magnet, and brush.

13. The method of claim 10 further comprising channeling fluid from the running sting into the well casing using a circulation valve.

14. The method of claim 10, wherein the centralizer is rotatable about the axis of the running string.

15. The method of claim 10, wherein the centralizer functions as a stabilizer in the expanded state protecting the well casing from the running string.

16. The method of claim 10, wherein the centralizer functions as a stabilizer in the expanded state protecting the well casing during operation of the running tool.

17. A running tool coupled to a running string, suspended in a well casing, and rotatable about an axis of the running string, the running tool comprising:

a running tool protector coupled to the running string;

a cleaning device for cleaning walls of the well casing; and a release assembly having a collet initially positioned below a liner hanger portion of a tubular and maneuverable to release the running tool from a surrounding tubular, and wherein the running tool protector is positioned below the collet and protects the running tool from the well casing while the running tool rotates about the axis during a cleaning operation.

18. The running tool of claim 17, wherein the cleaning device comprises at least one of a scraper, magnet, and brush.

19. The running tool of claim 17 further comprising a high flow rate circulation valve for channeling fluid from the running string into the well casing.

20. The running tool of claim 17, wherein the running tool protector comprises a set of bowstrings and the running tool protector is rotatable about the axis of the running string.

* * * * *